United States Patent [19]

Hickerson

[11] 4,248,385

[45] Feb. 3, 1981

[54] ADJUSTABLE NOZZLE

[76] Inventor: Frederick R. Hickerson, R.D. 6, Box 602, Newton, Sussex County, N.J. 07860

[21] Appl. No.: 99,399

[22] Filed: Dec. 3, 1979

[51] Int. Cl.[3] ..... B05B 1/12; B05B 1/30

[52] U.S. Cl. ..... 239/444; 239/533.1; 239/562; 239/581

[58] Field of Search ..... 239/444, 446-449, 239/533.1, 562, 570, 571, 581, 582; 137/599

[56] References Cited

U.S. PATENT DOCUMENTS

| | | | |
|---|---|---|---|
| 1,893,298 | 1/1933 | Moore | 239/448 X |
| 2,127,188 | 8/1938 | Schellin et al. | 239/448 X |
| 2,629,633 | 2/1953 | Wright | 239/448 X |

*Primary Examiner*—Andres Kashnikow

*Attorney, Agent, or Firm*—Nathan Edelberg; Robert P. Gibson; Max Yarmovsky

[57] ABSTRACT

An adjustable fluid control valve utilizes a fluid flow controlling piston in cooperation with a rotatable cap which causes fluid pressure to move the piston to any desired nozzle fluid flow control setting from closed to full open. The piston contains a fluid stream deflector which moves in cooperation with a manually adjusted knob to independently vary the nozzle fluid stream pattern to any desired adjustment from fine spray to straight stream. The simple, easy and quick adjusting cap and knob allows the fluid control valve operator to independently select and change fluid flow rates and nozzle spray patterns as desired.

8 Claims, 1 Drawing Figure

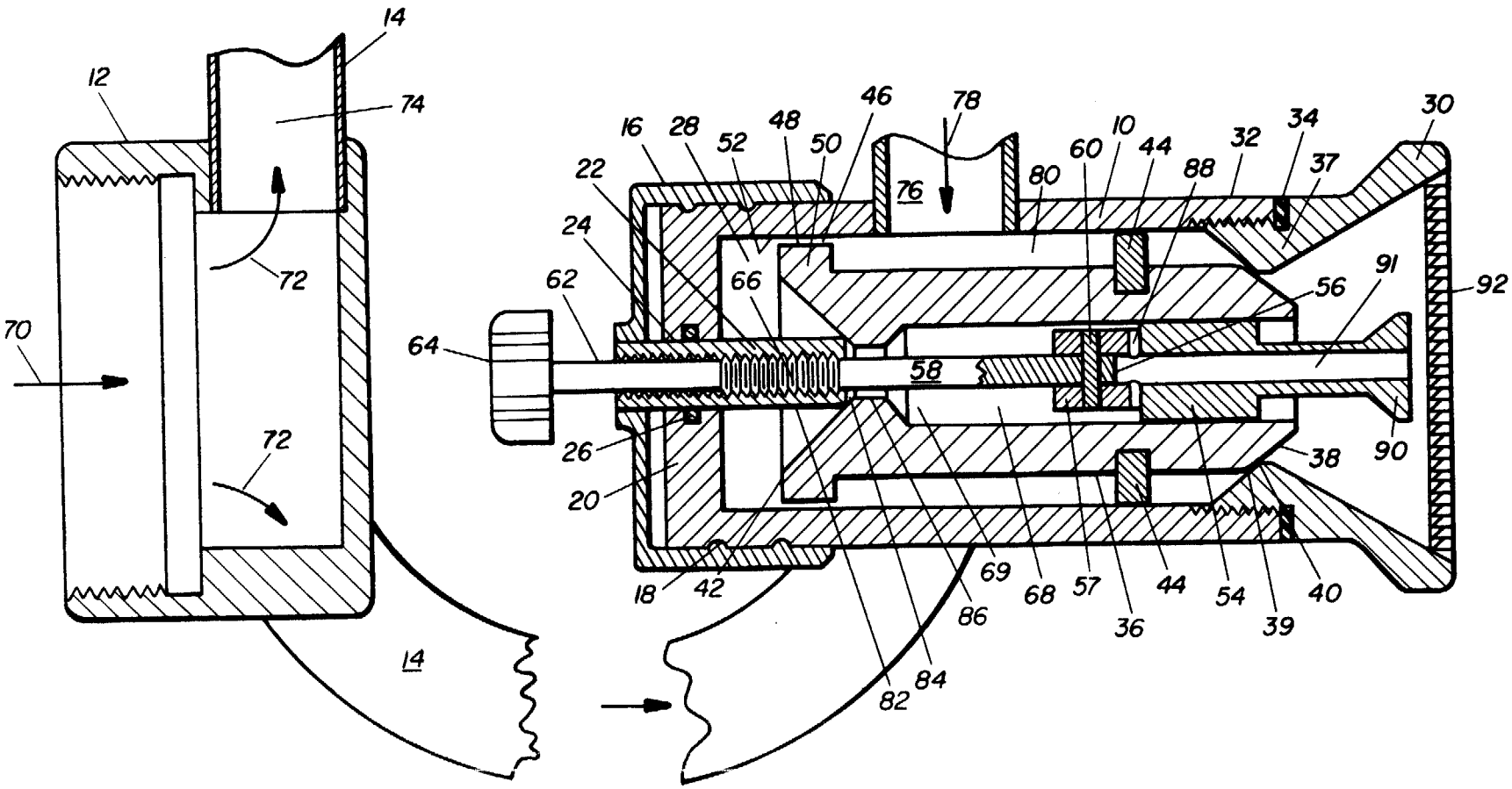
92
30
91
90
56
38
37
34
40
39
32
54
88
44
44
10
36
60
57
80
68
78
69
86
76
58
84
82
46
50
48
66
52
42
28
18
16
22
24
62
26
20
64
14
74
14
72
72
12
70

ADJUSTABLE NOZZLE

GOVERNMENTAL INTEREST

The invention described herein may be manufactured, used and licensed by or for the Government for Governmental purposes without the payment to me of any royalty thereon.

BACKGROUND OF THE INVENTION

Various means have been used in the past to control both the flow rate and the stream pattern of fluids from a nozzle. Prior art designs required an operator in order to adjust flow rate and pattern to work against the line pressure. In high pressure applications such as used in fire hose nozzles, large forces and/or sophisticated and complex mechanisms are frequently required in order to control the flow and stream pattern settings of the valve. Prior art large high pressure fire hose nozzles generally require several men to hold and control the flow rate and stream pattern settings. The complexity of prior art adjustable nozzle designs has prohibited the use of independent selection of flow and spray pattern control designs to low cost garden hose nozzle applications.

PRIOR ART STATEMENT

The present invention greatly furthers the state of the art disclosed in the U.S. Pat. No. 2,799,466 and patent application, Ser. No. 897,304 filed on Apr. 18, 1978, now U.S. Pat. No. 4,194,694. The present device provides for an infinitely variable independently controlled fluid flow rate from the nozzle full open to full closed position without the need for a separate shut off valve, and for a similar independently controlled stream pattern from fine spray to straight stream. In contradistinction the above references allow only infinitely variable flow from the valve full open to full closed positions and stream pattern which cannot be varied independent of the flow rate.

SUMMARY OF THE INVENTION

This invention relates to a device for independently controlling both fluid flow and stream pattern in a high pressure fluid control valve nozzle. Flow control is achieved by utilizing a vented piston valve member and balanced fluid pressure forces on the fore and aft sections of a piston valve member to open and close the nozzle orifice with a minimum of operator effort. Stream pattern control is achieved by utilizing an axially located fluid stream pattern deflector located at a fore end of a nozzle seat member and attached to a threaded control rod with an aft end control knob which is easily rotated to vary the fluid stream pattern. While the flow control and stream pattern control systems are interrelated into a single overall design, each may be operated independently from the other. The present invention solves the problems aforementioned in the prior art high pressure adjustable nozzles by providing independent fluid flow control and stream pattern control with a relatively small and inexpensive device which is simple to operate, small of size and weight, and reliable in performance due to reduced complexity of construction.

The present invention provides an independently operated adjustable fluid flow control means and independently adjustable stream pattern control means for a high pressure fluid control valve nozzle. Fluid flow rate is variably controlled by creating a line pressure unbalanced on fore and aft sections of a vented piston valve member. The stream pattern is independently variably controlled in a range between fine spray and straight stream by a stream pattern deflector.

This invention also provides an adjustable nozzle which has an independently operated adjustable fluid flow control means and independently adjustable stream pattern control means for a high pressure fluid control valve nozzle wherein the cost for manufacture is substantially reduced from prior art.

The present invention provides an independently operated adjustable fluid flow control means and an independently adjustable stream pattern control means for a high pressure fluid control valve nozzle of substantially reduced weight and size from prior art nozzles having similar flow and stream pattern capabilities.

In addition the present invention provides an independently operated adjustable fluid flow control means and independently adjustable stream pattern control means for high pressure fluid control valve nozzle which does not require substantial operator force to overcome high line pressure.

The present invention provides an independently operated adjustable fluid flow control and adjustable stream pattern control means for a high pressure fluid control valve nozzle which is more adaptable for remote control operation.

The present invention provides an independently operated adjustable fluid flow control means and independently adjustable stream pattern control means for a high pressure fluid control valve nozzle which can be economically adapted to garden hose nozzle design.

Further it is an object of this invention to provide an independently operated adjustable fluid flow control means and independently adjustable stream pattern control means for a high pressure fluid control valve nozzle which can conserve the use of water by allowing the operator to reduce the flow rate but still maintain the desired stream pattern.

For a better understanding of the present invention, together with other and further objects thereof, reference is made to the following descriptions taken in connection with the accompanying drawing.

BRIEF DESCRIPTION OF THE DRAWINGS

The drawing is a partial cutaway longitudinal diametral cross-sectional view of an adjustable high pressure fire hose nozzle configuration.

DESCRIPTION OF THE PREFERRED EMBODIMENTS

Referring now to the drawing, the adjustable high pressure cylindrical shaped nozzle body member 10 is hydraulically fixedly attached to an internally threaded hose connector 12 by two or more "U" shaped tube handles 14. A fluid flow control cap 16 has an internally threaded control cap thread 18 therein. Fluid flow control cap 16 is threadly disposed on externally threaded nozzle body aft end 20 of the exterior of nozzle body member 10. An internally threaded fluid flow control sleeve 22 is fixedly and axially disposed in fluid flow control cap 16. The fluid flow control sleeve 22 is slidably fitted into an axially located aft sleeve hole 24 in nozzle body member 10. An "O" ring 26 is operatively positioned in nozzle body member aft end 20 to seal and prevent leakage of the flowing fluid contained in rear nozzle body cavity 28. A nozzle seat member 30 is threadedly attached to the internally threaded nozzle body member fore end 32 of the nozzle body member 10 with an annularly shape sealing gasket 34. Sealing gasket 34 is positioned between the members 30 and 10 respectively to prevent leakage of the flowing fluid. A cylindrical piston valve member 36 is axially slidably disposed within the nozzle body member 10. The piston fore end 38 cooperates with the nozzle seat member 30 in controlling fluid flow from a full closed to full open position. The piston fore end 38 is conically tapered so that it makes circular contact with a conically convergent nozzle section 37 at the nozzle seat 40. The piston valve member 36 conically concave aft end 42 cooperates with the fluid flow control sleeve 22 whose position relative to the aft end 42 is determined by rotation of the fluid flow control cap 16. A plurality of radially positioned piston guide pins 44 are located on a middle outside surface section of the piston valve member 36. Piston guide pins 44 help center the piston valve member 36 within the nozzle seat member 30 to insure uniform circular flow cross-sectional area across the nozzle seat 40. When in an open position, a controlled clearance space 46 is maintained between the exterior wall 48 of cylindrically shaped piston shoulder 50 of the piston valve member 36 and the interior wall 52 of the central cavity of nozzle body member 10 to allow fluid to enter rear nozzle body cavity 28 and to exert pressure on the aft end 42 of piston valve member 36. A cylindrical fluid stream pattern deflector member 54 is slidably axially located within piston valve member 36 and fixedly connected at rear end 57 to the control rod forward end 56 of a fluid stream pattern control rod 58 by a transversly positioned connector pin 60. The control rod aft end 62 of control rod 58 is connected to a fluid stream pattern control knob 64. A control rod threaded section 66 is operatively disposed on a center portion of the fluid stream pattern control rod 58 to cooperate with the internally threaded fluid flow control sleeve 22 to slidably position the fluid stream pattern deflector member 54 in an axially disposed piston deflector slide bore 68. The flowing fluid, as indicated by arrow 70 enters internally threaded hose connector 12 then divides as shown by arrows 72 and proceeds into a plurality of "U" shaped tube handles 14 at the tube handle inlets 74 and exits the "U" shaped tube handles 14 at the tube handle outlets 76 in the direction shown by arrow 78. The flowing fluid flows through the piston fluid flow-passage 80 and exits through the nozzle seat member 30 when piston valve member 36 is in an open position. A positioning pressure balance on the fore and aft ends 38 and 42 of piston valve member 36 is obtained by a fluid pressure relief passage across the control sleeve fore end 82 of the fluid flow control sleeve 22 and the fluid flow control sleeve piston seat 84 of the piston valve member 36. A pressure relief piston passage aft end bore 86 in piston valve member 36 allows fluid pressure to be relieved into the piston deflector slide bore 68. Fluid passes then into a plurality of radially positioned pressure relief passage holes 88 of the fluid stream pattern deflector member 54 and exits through the deflector pressure relief passage divergently shaped fore end 90 via axial relief bore 91.

In operation, the fluid flow is adjusted by rotating the fluid flow control cap 16 and the fluid stream pattern is adjusted by rotating the fluid stream pattern control knob 64. In this manner, the fluid flow and the fluid stream pattern are independently adjusted in any combination of fluid flow from closed to full open and fluid stream pattern from fine spray to straight stream.

When the fluid flow control cap 16 is rotated to the closed position, as shown, the fluid pressure source when attached to hose connector 12 allows the fluid pressure to act through the "U" shaped tube handles 14 into the annular piston fluid flow passage 80. From passage 80 the fluid pressure is contained on the surface 39 of piston valve member 36 which is in contact with the nozzle seat member 30 at the point of the nozzle seat 40. The fluid pressure also acts in the rear nozzle body cavity 28 between the aft end 42 of the piston valve member 36 and the nozzle body member 10 since the controlled clearance space 46 between the interior wall 52 of the nozzle body member 10 and the exterior wall 48 of the piston valve member 36 provides a restricted fluid passage. With the fluid flow control cap 16 in the closed position, the fluid pressure cannot be relieved through the relief passage consisting of piston passage aft end bore 86, piston deflector slide bore 68, deflector pressure relief passage holes 88 and finally deflector pressure relief passage fore end 91, since the control sleeve fore end 82 of fluid flow control sleeve 22 of the fluid flow control cap 16 is in contact with piston valve member 36 at the fluid flow control sleeve piston seat 84. In the above described fluid flow closed position the fluid pressure in rear nozzle body cavity 28 which is equal to the flowing fluid inlet pressure to the piston fluid flow passage 80, acts over the wetted cross-sectional area of the aft end 42 of piston valve member 36 causing a closing force larger than the opposing opening force caused by the same pressure acting over the smaller wetted cross-sectional area of the fore end 39 of piston valve member 36 between the contact line of the nozzle seat 40 and the full diameter of the exterior wall 48.

When the fluid flow control cap 16 is rotated to any selected open position, the control sleeve fore end 82 is moved to the left and away from the fluid flow control sleeve piston seat 84. This allows the fluid pressure in rear nozzle body cavity 28 to be vented through pressure relief passage aft end bore 86, piston deflector chamber bore 68, pressure relief passage holes 88 and deflector pressure relief passage fore end 91. With a reduced fluid pressure in rear nozzle body cavity 28 the closing forces on the piston valve member 36 drop below the opening forces and the piston valve member 36 moves off its nozzle seat 40 allowing fluid flow to exit from the nozzle seat member 30. The piston valve member 36 continues to move to the selected open position until a force balance on each side of the piston valve member 36 is reached. In this balanced position a throttling of the relief passage across the flow control sleeve seat 84 causes the reduced pressure in cavity 28 needed to balance the opening and closing forces on the piston valve member 36. The reduced pressure results since the cross-sectional area of the controlled clearance between the interior wall 52 and the exterior wall 48 is less than the cross-sectional area of the pressure relief passage down stream of the fluid flow control sleeve seat 84. By turning the fluid flow control cap 16 in a closing direction, pressure is increased in rear nozzle body cavity 28 upsetting the force balance on the piston valve member 36 with a resulting movement of the piston valve member 36 to a force balance position which results in reduced fluid flow.

With any selected fluid flow setting of the fluid flow control cap 16 described above, the fluid stream pattern control knob 64 may be rotated to change the fluid stream pattern exiting from nozzle seat member 30. Since the fluid stream pattern deflector member 54 is rigidly attached to fluid stream pattern control rod aft end 62 which in turn is rigidly attached to the fluid stream pattern control knob 64, rotation of the fluid stream pattern control knob 64 causes a movement with resulting change in position of the fluid stream pattern deflector member 54. The intentional movement of the fluid stream pattern deflector nozzle 54 to the right or left by clockwise or counterclockwise rotation of the fluid stream pattern control knob 64, results from engagement of the control rod thread section 66 with the thread inside the fluid flow control sleeve 22. Moving the fluid stream pattern deflector member 54 to the left or onto the piston deflector slide bore 68 causes the flowing fluid stream pattern to change from a spray position toward a straight stream position which is reached when the fluid stream pattern deflector member 54 is moved completely into the aft end 69 of piston deflector slide bore 68.

It is noted that parallel positioned spray baffles 92 on the inside fore end of the nozzle seat member 30 assist the fluid stream pattern deflector member 54 in deflecting back a portion of the fluid spray to eliminate obtaining a normally undesirable hollow spray cone pattern.

It is also noted that the low operating torque forces and the readily accessible positions of the fluid flow control cap 16 and the fluid stream pattern control knob 64 make the addition of state of the art remote actuators simple and inexpensive. Remote control of the fluid flow and the stream pattern are required when fire hose nozzles are placed in positions such as high snorkel ladders and platforms where firemen may not venture due to fire and other hazards. It is further noted that the fluid stream pattern control knob 64 and the control rod thread 66 can be simply eliminated and replaced by a state of the art piston actuator, not shown, with the capability of cycling the fluid stream pattern deflector member 54 rapidly in and out of the deflector chamber 68 with resulting rapid cycling of the fluid stream pattern from straight stream to spray. This is advantageous in remote agricultural irrigation applications and may be advantageous in fire fighting and other applications. A flow indicator such as an arrow, not shown, may be placed on the fluid flow control cap 16 and matched to flow rate settings marked on the outside exposed portion of the aft end of the nozzle body member 10. These flow rate settings allow an operator to select a desired flow rate, generally given in gallons per minute (gpm). Also included as a setting is a "flush" position which is normally at the maximum flow position and is used by the operator to flush out any obstructions or foreign matter that may have entered the fire hose and lodged in the nozzle seat 40. An indicator on the fluid stream pattern control knob 64 not shown, can be used to alert an operator as to which direction to turn control knob 64 in order to obtain the straight stream and spray (sometimes referred to as fog) positions.

While there has been described and illustrated specific embodiments of the invention, it will be obvious that various changes, modifications and additions can be made herein without departing from the field of the invention which should be limited only by the scope of the appended claims.

What is claimed is:

1. An adjustable nozzle for regulating high pressure liquid which comprises:

a cylindrically shaped nozzle body member having an internally threaded fore end, partially closed externally threaded aft end, said aft end having a sleeve hole axially positioned therethrough which communicates with a central cavity;

nozzle means threadedly attached to said fore end of said nozzle body member for controlling spray pattern and flow rate of said high pressure liquid passing therethrough;

piston means, slidable disposed within said central cavity of said body member intermediate said aft end of said body member and said nozzle means for regulating the flow rate of said high pressure liquid through said nozzle means;

means threadedly attached to said aft end of said nozzle body member and slidably passing therethrough for variably adjusting the position of said piston means in said central cavity of said nozzle body member to independently control said flow rate and for axially supporting means for independently adjusting a spray pattern of said high pressure liquid passing through said nozzle means;

"O" ring means operatively located in said sleeve hole of said aft end of said nozzle member, said "0" ring means preventing loss of liquid from said nozzle body member when said means for variably adjusting the flow rate and the spray pattern slidably passes through said aft end of said nozzle body member; and hose connecting means fixedly attached to said nozzle body member and communicating with said nozzle body member central cavity for supplying high pressure liquid to said nozzle body member from a plurality of inlets, and for providing means for conveniently holding said adjustable nozzle while adjusting said liquid flow rate and said spray pattern.

2. An adjustable nozzle as recited in claim 1 which includes an annularly sealing gasget member operatively disposed intermediate said fore end of said nozzle body member and said nozzle means.

3. An adjustable nozzle as recited in claim 2 wherein said nozzle means includes parallel positioned spray baffles on an inside fore end to deflect a portion of said liquid passing through said nozzle means to eliminate obtaining a hollow-spray cone pattern.

4. An adjustable nozzle as recited in claim 3 wherein said nozzle means includes a convergent conical nozzle section which contacts said piston means to form a circular nozzle seat contact line.

5. An adjustable nozzle as recited in claim 2, 3 or 4 wherein said piston means includes, a piston valve member having a tapered fore end, conically concave aft end with a contol sleeve piston seat therein, a cylindrically shaped piston shoulder disposed on said aft end, said piston shoulder slidably disposed in said central cavity of said nozzle body member to provide a controlled clearance space between an interior wall of said nozzle body member and said piston shoulder, an axially disposed piston deflector slide bore, a piston passage aft end bore which is axially disposed intermediate said piston deflector slide bore and said conically concave aft end, and a plurality of radially peripherally positioned guide pins for centering said tapered fore end of said piston valve member in said convergent conical nozzle section to insure uniform circular flow cross-sectional area at said nozzle contact line.

6. An adjustable nozzle as recited in claim 5 wherein said means for variably adjusting the position of said piston means includes:

a fluid flow control cap threadedly coupled to said externally threaded aft end of said nozzle body member, said cap having a fluid flow control internally threaded sleeve fixedly, axially disposed in said control cap, said control sleeve having a flow control sleeve piston seat located on a fore end of said control sleeve;

a control rod threadedly attached to said control sleeve, said control rod having a forward end axially passing through said piston passage aft end bore to axially locate in said piston deflector slide bore, and a control knob fixedly positioned on the other end; and a fluid stream pattern deflector member slidably disposed in said deflector slide bore, said fluid stream pattern deflector member fixedly pinned to said forward end of said control rod.

7. An adjustable nozzle as recited in claim 6 wherein said fluid stream pattern deflector member includes a rear end pinned to said forward end of said control rod, a divergently shaped fore end of a diameter sufficiently small to be withdrawn into said piston deflector slide bore of said piston valve member, and an axial relief bore which communicates with a plurality of radially disposed pressure relief passage holes, said pressure relief passage holes allow fluid pressure to be relieved from the deflector slide bore to said axial relief bore.

8. An adjustable nozzle as recited in claim 7 wherein said hose connecting means includes:

an internally threaded hose connector; and a plurality of "U" shaped handled fluidically connecting said hose connector to said nozzle body member.

* * * * *